United States Patent [19]

Schneider

[11] Patent Number: 4,962,652

[45] Date of Patent: Oct. 16, 1990

[54] TOPPER LOCK

[76] Inventor: Randy R. Schneider, 5357 N. 106th Street, Milwaukee, Wis. 53225

[21] Appl. No.: 420,389

[22] Filed: Oct. 12, 1989

[51] Int. Cl.[5] ..... E05B 65/00

[52] U.S. Cl. ..... 70/89; 70/71; 70/120; 70/159; 292/DIG. 14

[58] Field of Search ..... 70/89, 90, 118–120, 70/158–169, 240, 69–71; 292/DIG. 14

[56] References Cited

U.S. PATENT DOCUMENTS

| | | | |
|---|---|---|---|
| 594,759 | 11/1897 | Schnurr | 70/71 X |
| 1,536,773 | 5/1925 | Ciaccio | 70/240 |
| 2,022,886 | 12/1935 | Jett et al. | 70/159 X |
| 2,055,289 | 9/1936 | Hanan | 70/240 |
| 2,285,301 | 6/1942 | Nelson | 292/DIG. 14 X |
| 2,385,148 | 9/1945 | Marcus | 70/89 X |
| 2,771,313 | 11/1956 | Blake | 70/89 X |
| 4,476,700 | 10/1984 | King | 70/120 X |
| 4,547,006 | 10/1985 | Castanier | 70/71 X |

FOREIGN PATENT DOCUMENTS

| | | | |
|---|---|---|---|
| 2029947 | 12/1971 | Fed. Rep. of Germany | 70/69 |
| 414732 | 8/1946 | Italy | 70/71 |

*Primary Examiner*—Robert L. Wolfe
*Assistant Examiner*—Suzanne L. Dino
*Attorney, Agent, or Firm*—Richard C. Litman

[57] ABSTRACT

A lock for a window on a topper cap found on pickup trucks and the like. The lock comprises an inner housing having a rotating geared pinion engaging two racks. The racks are attached to deadbolts that can extend and engage the frame tubing on opposite sides of the pinion gear. An outer housing surrounds the inner housing and the deadbolts. A handle shaft is disposed through the outer and inner housings to attach to the pinion gear. Turning the handle turns retracts or extends the deadbolts. The whole assembly can be easily installed by attaching the outer housing to the window inside surface. The housings make it difficult for intruders to open the window by tampering with the mechanical components.

10 Claims, 1 Drawing Sheet

TOPPER LOCK

BACKGROUND OF THE INVENTION

1. Field of the Invention

The present invention relates to vehicle locks. More particularly it relates to locks for the rear tailgate window on the topper caps commonly mounted on the rear beds of pickup trucks. Such locks usually having a deadbolt connected to a rack and pinion gear that moves the deadbolts into a locked position upon turning of the pinion gear.

2. Description of the Prior Art

The following is a discussion of prior patents felt to be related to, but not disclosing, whether singly or in combination, the applicant's present invention.

U.S. Pat. No. 1,536,773 issued to Ciaccio discloses a locking attachment for vehicles comprising two parallel racks engageable with a pinion and traveling in guides when the pinion is rotated until they secure or release the hood.

U.S. Pat. No. 2,055,289 issued to Hanan discloses a locking attachment for a automobile hood having a rotating central gear attached to two lever arms. Rotation of the gear pulls the lever arms out of locking engagement.

U.S. Pat. No. 2,022,886 issued to Jett et al. discloses rumble seat lock having a single rack engaged to a pinion. Rotating the pinion horizontally moves the rack to disengage the locking position.

None of the prior art patents cited above disclose housings for the gearing or deadbolts. Such devices when used with a window would allow an intruder to punch a hole in the window and tamper with the exposed lock mechanism. By providing housings to surround the working parts of the lock it prevents tampering with the lock.

SUMMARY OF THE INVENTION

The present invention comprises a geared pinion having two geared racks matingly engaged on either side. The racks are attached to deadbolts that can slide behind the tubing of a topper cap to lock the back window in place. A housing that contains the pinion and geared potions of the racks serves to protect these components. The deadbolts butt up against stop clips to limit their extension.

The whole assembly would fit on the inside of the window of the topper cap. The deadbolts would have an outer housing to cover and protect them from outside interference. A key lock would unlock a rotating handle connected to the pinion, so as to be able to turn the handle and release the deadbolts. The deadbolts are angled away from the geared rack portions and the pinion. This is done to make sure that the deadbolts reach the frame tubing which does not extend down all the way to the bottom of the topper cap. To provide for a snug fit between the window and the rest of the topper cap frame strike plates would be fit behind the frame tubing. This allows the plates to take the wear of the deadbolts rubbing and not the tubing of the frame.

Accordingly, it is one object of the present invention to provide a window lock for a topper cap having two separate deadbolts.

It is a further object of the present invention to provide a rear tailgate window lock for a topper cap having a protectively housed pinion and rack assembly.

It is a yet further object of the present invention to provide a window lock for topper cap having means to limit the extension of the deadbolts.

It is a still further object of the present invention to provide a window lock for a topper cap having the deadbolts disposed on either side of the pinion.

It is still another object of the present invention to provide a window lock for a topper cap having means to provide a tight fit between the window and the rest of the topper cap.

It is yet another object of the present invention to provide a window lock having means to prevent rotation of the pinion gear and movement of the deadbolts.

These and other objects of the present invention will become readily apparent upon further review of the following specification and drawings.

BRIEF DESCRIPTION OF THE DRAWINGS

Similar reference characters denote corresponding features throughout the drawings.

A DETAILED DESCRIPTION OF THE PREFERRED EMBODIMENT

Figure 1:
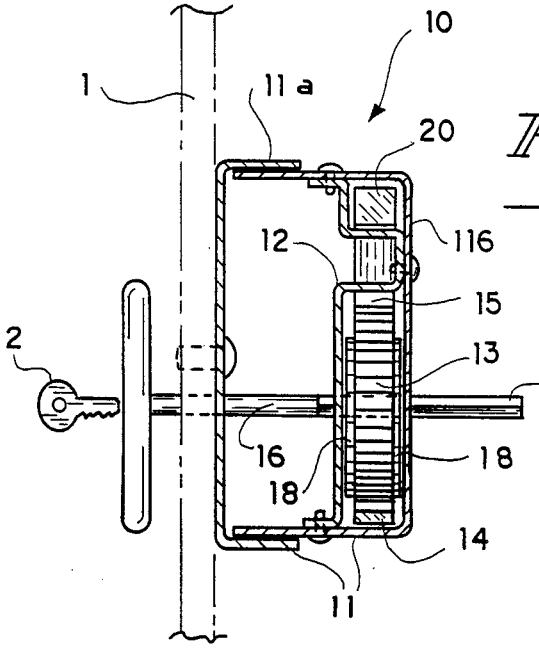
FIG. 1 shows an end view in cross-section of the window lock.

The window lock assembly 10 comprises an outer housing 11 which protects the deadbolts 20, 21 and an inner housing 12 which serves to protect the pinion 13 and racks 14, 15. Outer housing 10 is bolted to the lower inside of the topper window 1 as shown in FIG. 1. Outer housing consists of two sections 11*a* and 11*b* which fit together to form a single housing unit. Passing through window 1, section 11*a* and inner housing 12 is the handle shaft 16 having a square end 16*a* that mates with a corresponding depression 13*a* in the pinion gear 13. Rotation of shaft 16 causes rotation of the pinion gear 13 and thereby extends or retracts the deadbolts 20, 21.

Figure 2:
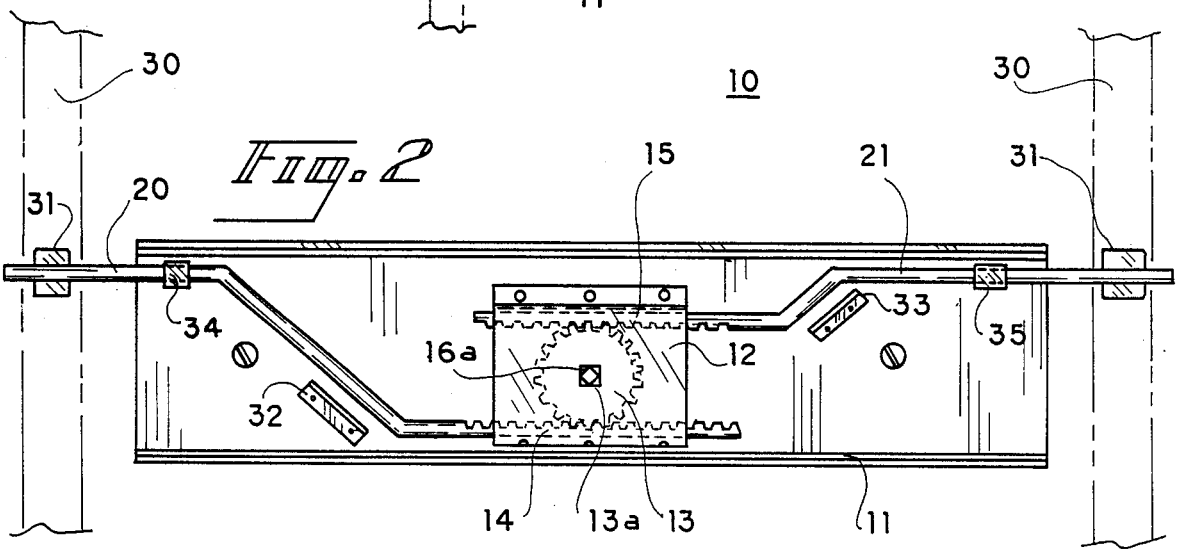
FIG. 2 shows a front view in cross-section of the window lock.

Pinion gear 13 is mounted between racks 14, 15 as best shown in FIG. 2. Turning of the pinion gear 13 causes the racks 14, 15 to move in and out of inner housing 12. Inner housing 12 is attached to section 11*b* of the outer housing 11. The inner housing serves to keep the pinion gear 13 and racks 14, 15 in position. Placed on either side of the pinion gear 13 are spacer washers 18 for reducing the wear on the outer and inner housings 11, 12.

Figure 3:
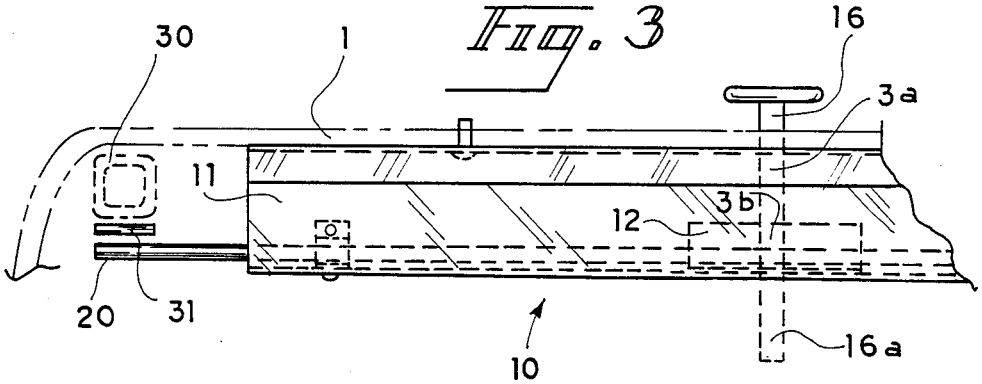
FIG. 3 shows a top view of the window lock in cross-section.

The deadbolts 20, 21 attached to the racks 14, 15 are angled upward initially so as to have enough room to clear the bottom of the topper cap frame. The deadbolts 20, 21 when extended would slip behind the vertical frame tubing 30 of the topper cap such as shown in FIG. 3. A strike plate shim 31 would be placed between the tubing 30 and the deadbolts 20, 21 so that the repeated movement of the deadbolts 20, 21 would not wear on the tubing 30.

In order to limit the extent of the movement of the deadbolts 20, 21 stop clips 32, 33 would be placed on section 11*b*. When the deadbolts 20, 21 ran up against the stop clips 32, 33 they would be prevented from moving further. This would help to prevent damage to the side of the topper cap. The deadbolts 20, 21 are also constrained by retainer clips 34, 35 mounted on the upper part of section 11*b*.

Handle 16 which allows turning of the pinion gear 13 to open or close the window 1 by moving the deadbolts 20, 21 can also be locked by a key 2 to prevent the turning of the handle 16. This effectively locks the deadbolts 20, 21 in place and thus locks the window 1 securely. Since the deadbolts 20, 21, racks 14, 15 and pinion gear 13 are housed out of sight it is difficult to tamper with the lock assembly 10. By punching a hole through the window 1 an intruder will still not be able to quickly open the locked window 1 because the working mechanisms are securely housed.

The housings 11 and 12 also allow for easy installment of the locking device by simply securing the outer housing 11 and its contents to the window 1 by for example bolts. Handle 16 can then be inserted through a bored hole 3 in the window 1 and inserted through similar holes **3*a* and 3*b* in the housings 11 and 12. The square end 16*a* of the handle would engage the square aperture 13*a* of the pinion gear 13**.

It is to be understood that the present invention is not limited to the sole embodiment described above, but encompasses any and all embodiments within the scope of the following claims.

I claim:

1. A lock for a window on a topper cap including:

an outer housing extending along a major widthwise portion of said window;

an inner housing mounted inside and completely enclosed by said outer housing and distally positioned from said window;

a rotating toothed pinion gear mounted inside said inner housing;

toothed racks mounted inside said inner housing on opposite sides of said rotating pinion gear so that the gear teeth and the rack teeth engage;

deadbolts attached to and extending in opposite directions away from said geared racks, said deadbolts extending through said inner housing and said outer housing;

said outer housing mounted to an inner surface of said topper cap window, said deadbolts able to extend past the frame tubing of said topper cap thereby locking said window closed.

2. The lock according to claim 1 including:

a handle comprising a shaft disposed through said window and said outer and inner housings and attached to the center of said pinion gear such that rotating said shaft rotates said pinion gear and thus extends or retracts said deadbolts.

3. The lock according to claim 1 wherein:

said deadbolts having an end section disposed parallel to said racks and said deadbolts having a section proximal said racks that is angularly disposed in relation to said racks.

4. The lock according to claim 1 including:

means to prevent said handle from being rotated.

5. The lock according to claim 4 wherein:

said means to prevent said handle from being rotated includes a key and a lock mounted inside said handle.

6. The lock according to claim 2 including:

washers disposed on opposite sides of said pinion gear and said racks, said handle shaft disposed through said washers, said washers for reducing the wear between said pinion gear and said inner and outer housings.

7. The lock according to claim 1 including:

plates disposed between said deadbolts and said frame tubing for the purpose of preventing wear of the frame tubing.

8. The lock according to claim 3 including:

means to limit the extension of said deadbolts.

9. The lock according to claim 8 wherein:

said means to limit the extension of said deadbolts includes barrier means disposed in the paths of said proximal sections of said deadbolts.

10. The lock according to claim 1, wherein:

said outer housing extends substantially the length of said deadbolts.

* * * * *